US007806281B2

(12) United States Patent
Goldstein

(10) Patent No.: US 7,806,281 B2
(45) Date of Patent: Oct. 5, 2010

(54) CONTINUOUS LENGTH TELESCOPING RODS

(75) Inventor: Allan Goldstein, Old Tappan, NJ (US)

(73) Assignee: Source Global Enterprises, Inc., Bronx, NY (US)

( * ) Notice: Subject to any disclaimer, the term of this patent is extended or adjusted under 35 U.S.C. 154(b) by 502 days.

(21) Appl. No.: 11/843,769

(22) Filed: Aug. 23, 2007

(65) Prior Publication Data

US 2008/0053938 A1 Mar. 6, 2008

Related U.S. Application Data

(60) Provisional application No. 60/823,815, filed on Aug. 29, 2006.

(51) Int. Cl.
*A47H 1/08* (2006.01)

(52) U.S. Cl. ..... 211/105.3

(58) Field of Classification Search ..... 211/105.3, 211/123, 206; 248/200.1, 214, 251, 256, 248/257, 258; 160/330
See application file for complete search history.

(56) References Cited

U.S. PATENT DOCUMENTS 1,168,990 A * 1/1916 Altschul ..... 160/391
1,270,634 A * 6/1918 Lowe ..... 211/105.2
1,288,493 A * 12/1918 Boye ..... 211/105.3
1,773,796 A * 8/1930 Settlemoire ..... 211/105.3
2,201,043 A * 5/1940 Kirsch ..... 211/105.3
2,225,211 A * 12/1940 Erickson ..... 16/402
2,385,608 A * 9/1945 Castagna ..... 403/109.6
2,560,942 A * 7/1951 Ford et al. ..... 211/105.3
2,639,930 A * 5/1953 Thornton ..... 403/144
2,710,695 A * 6/1955 Mazany ..... 211/105.3
2,825,469 A * 3/1958 Watkins et al. ..... 211/105.3
2,945,595 A * 7/1960 Gardner, Jr. ..... 211/105.3
2,969,881 A * 1/1961 Lilly ..... 211/105.3
4,465,198 A * 8/1984 Martin ..... 211/105.3
4,742,926 A * 5/1988 Mather ..... 211/105.3
4,825,611 A * 5/1989 Bassett ..... 52/222
5,104,269 A * 4/1992 Hardison ..... 410/149
5,345,623 A * 9/1994 Dearman ..... 4/608
6,233,877 B1 * 5/2001 Monroe ..... 52/37
7,325,696 B2 * 2/2008 Matthew et al. ..... 211/105.3
2005/0199567 A1 * 9/2005 Tardiff ..... 211/105.3
2008/0053938 A1 * 3/2008 Goldstein ..... 211/105.3

* cited by examiner

*Primary Examiner*—Sarah Purol
(74) *Attorney, Agent, or Firm*—Levine & Mandelbaum

(57) ABSTRACT

A telescoping rod which can be telescoped between a minimum length and a maximum length is formed from three members two of which are shorter than and slidably mountable on a longer member. A telescoping rod can also be formed from five of the shorter members and two of the longer members with a minimum length equal to the maximum length of the rod formed from three members and a maximum length equal to 2½ times the minimum length of the rod formed from three members.

4 Claims, 2 Drawing Sheets

CONTINUOUS LENGTH TELESCOPING RODS

BACKGROUND OF THE INVENTION

This invention pertains to telescoping rods, e.g. telescoping curtain rods. More specifically, the invention pertains to multi-segmented rods having a range of lengths extending from a minimum length to a maximum length.

The widths of spaces to be covered with curtains or drapes vary greatly. In order to accommodate such spaces, fixed length curtain rods must be made in a correspondingly large number of lengths. Because it is economically impractical for curtain rod suppliers to stock rods in such a large number of sizes, fixed rods must often be custom made thereby increasing their cost and resulting in an often undesirable delay before the rods are available for use.

The aforementioned problems associated with fixed rods have been overcome through the use of adjustable rods. It is known in the art to provided curtain rods having multiple segments slidably connected whereby one segment can be received in another for telescoping movement to extend or retract the multi-segmented rod over a continuous range between a minimum length and a maximum length.

The minimum length is achieved by having the rod segment with a smaller transverse dimension, e.g., diameter, fully or almost fully received within a segment having a larger transverse dimension or diameter. The maximum length of such a multi-segmented telescoping rod is achieved by having the rod segment with a smaller transverse dimension fully extend from the segment having the larger transverse dimension or diameter, except for a small overlap between the segments which is required to keep the segments from sagging or completely separating.

Although prior art telescoping rods perform their function admirably, insofar as providing consumers with "off-the-shelf" rods which can be purchased at minimal cost and without the delays associated with custom rods, they are still inefficient. In order to accommodate a large range of lengths, even multi-segmented rods must be stocked in many sizes to prevent gaps in the lengths of available curtain rods available to consumers.

Prior art rods intended to span greater distances than those intended to span lesser distances are generally fabricated with segments having proportionally greater lengths. This requires that rod segments of numerous lengths be manufactured and that telescoping rods having various ranges be stocked. In order to avoid gaps in the range of available coverages, there is usually a redundancy between telescoping curtain rods having different ranges.

SUMMARY OF THE INVENTION

The present invention overcomes the shortcomings of prior art telescoping rods by providing a telescoping segmented curtain rod which can span one range of lengths between a first minimum length and a first maximum length. Two identical telescoping segmented curtain rods in accordance with the invention can have their segments combined to form a curtain rod which can span a range of lengths between a second minimum length equal to the first maximum length, and a second maximum length greater than the first maximum length.

DESCRIPTIONS OF THE DRAWINGS

DESCRIPTION OF THE PREFERRED EMBODIMENT

Figure 1:
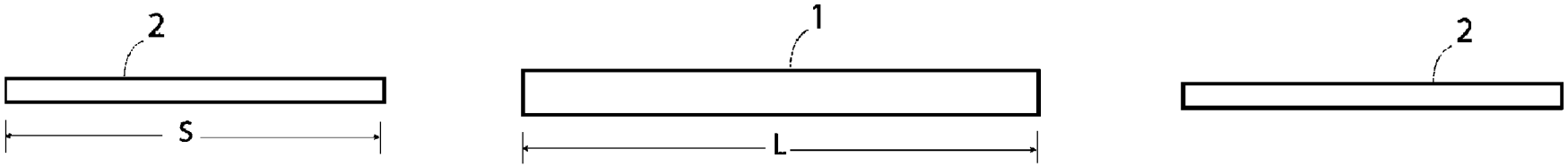
FIG. 1 is an exploded side elevation view of a curtain rod in accordance with the invention.

Referring now to FIG. 1 of the drawings there is shown a curtain rod having a central hollow tubular member or segment 1 and two hollow tubular end segments 2. Segment 1 is longer than each of segments 2.

The segments 1 and 2 may be circular in cross section or may have a cross section that is rectangular or of other geometry as will be known to those skilled in the art. Although not necessary, it is preferable that the segments 1 and 2 have cross sections which are geometrically similar.

Each of the segments 1 and 2 has a hollow axial bore or opening. Segment 1 has a larger cross section than each of segments 2. The opening in segment 1 has a diameter slightly larger than a corresponding outer diameter in segment 2 whereby each of the segments 2 may be slidably received or nested within segment 1. A minimum overlap P between a short segment 2 and a long segment 1 within which the short segment 2 is nested must be maintained to prevent instability and separation of the rod formed by the segments 1 and 2.

In accordance with the invention, the long segment 1 has a length equal to L and each of the short segments 2 has a length equal to S where L=S+2 P.

Figure 2:
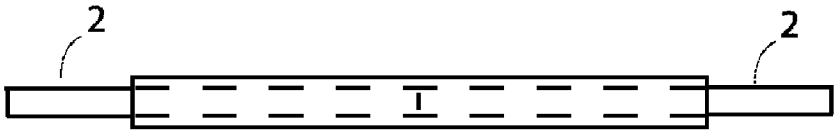
FIG. 2 is a side elevation view of the curtain rod of FIG. 1 in a retracted disposition.

As can be seen in FIG. 2, the two segments 2 can be received in segment 1 with their inner ends in mutual engagement and their outer ends extending from segment 1. In the disposition shown in FIG. 2, the curtain rod has an overall length of 2 S, that is, the sum of the lengths of each of the two segments 2. For a rod having a central segment 56 inches in length and two end segments each of which is 50 inches in length, the length of the retracted rod as shown in FIG. 2 will be 100 inches.

Figure 3:
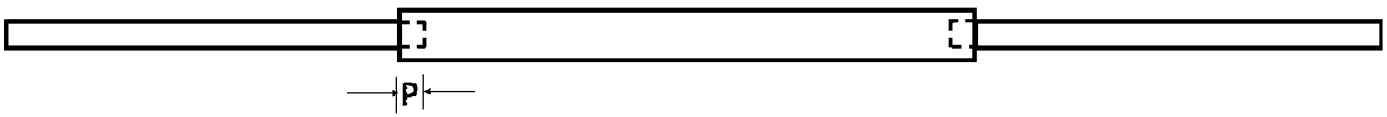
FIG. 3 is a side elevation view of the curtain rod of FIG. 1 in an extended disposition.

Referring now to FIG. 3, the telescoping rod is shown with each of its segments 2 fully extended from the central segment 1, each end of the central segment 1 overlapping an end of the adjacent segment 2 a distance equal to P. The length P of each overlap is selected to be the minimum which prevents sagging or separation of the overlapping members.

P will vary with the rigidity of the materials from which the members are formed, the tightness of the fit, and the geometry of the rod segments. P should preferably be in the range of 0.04 S-0.08 S. Goods results have been found when P=0.06 S in that sagging and separation of overlapping segments is prevented while the maximum length of to which the curtain rod may be extended is no unduly shortened.

In the disposition shown in FIG. 3, the telescoping rod has a length equal to 2 S+L−2 P. For a rod having a central segment 56 inches in length, two end segments each of which is 50 inches in length, and an overlap of three inches between the central segment 1 and each end segment 2, the length of the extended rod as shown in FIG. 3 will be 150 inches.

Figure 4:
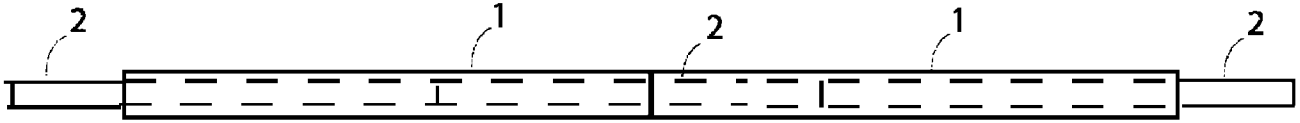
FIG. 4 is a side elevation view of curtain rod formed by combining segments taken from two identical rods, each of which is illustrated in FIG. 1, in a retracted disposition.

Referring now to FIG. 4 of the drawings there is shown a curtain rod formed from the segments of two of the curtain rods illustrated in FIGS. 1-3. The rod shown in FIG. 4 has two central segments 1 in end-to-end abutment, and three end segments 2 also in end-to-end abutment. The fourth end segment 2 is not used in the rod shown in FIG. 4.

The central one of the three short segments 2 shown in FIG. 4 resides fully within the openings of the two adjacent large segments 1. Each of the two end segments 2 extends from an adjacent end of the sleeve formed by the two abutting large segments 1. In the disposition shown in FIG. 4, the telescoping rod has a length equal to 3 S. For a rod having each long segment 1 equal to 56 inches in length, and each of three short segments equal to 50 inches in length, the length of the retracted rod as shown in FIG. 4 will be 150 inches, i.e., equal to the length of the fully extended single rod shown in FIG. 3.

Figure 5:
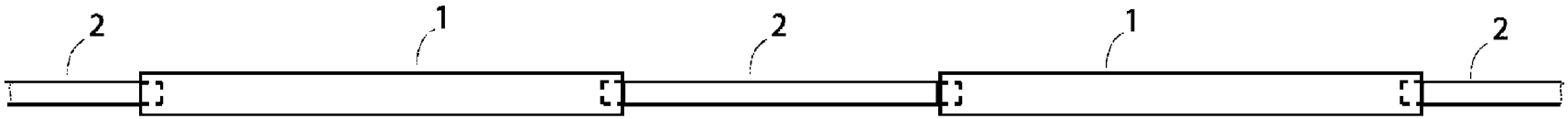
FIG. 5 is a side elevation view of the curtain rod of FIG. 4 in an extended disposition.

Referring now to FIG. 5, the telescoping rod of FIG. 4 is shown with each of its end segments 2 fully extended from an adjacent one of two long segments 1, the long segments 1 being separated to expose the central short segment previously hidden within the abutting long segments. Except for the free ends of the two end short segments 2, each end of each short segment 2 is overlapped by an end of an adjacent long segment 1 by a distance equal to P. In the disposition shown in FIG. 5, the telescoping rod has a length equal to 3 S+2 L−4 P. For a rod having two long segments 1 each of which is 56 inches in length, three short segments 2, each of which is 50 inches in length, and an overlap of three inches between the long segments 1 and short segments 2, the length of the extended rod as shown in FIG. 3 will be 250 inches.

Thus it is seen that a single telescoping curtain rod formed from three segments of only two sizes can be used alone or in combination with anther such rod to span distances from twice the length of the smaller segment to five times the length of the smaller segment, as shown below.

L=length of long segment 1

S=length of each short segment 2

P=length of each overlap $R1_{min}$=minimum length of rod formed from two short segments 2 and one long segment 1.

$R1_{max}$=maximum length of rod formed from two short segments 2 and one long segment 1.

$R2_{min}$=minimum length of rod formed from three short segments 2 and two long segments 1.

$R2_{max}$=maximum length of rod formed from three short segments 2 and two long segments 1.

S=L−2 P or L=S+2 P $R1_{min}$=2 S $R1_{max=L+}$2 S−2 P $R2_{min}$=3 S=L+2 S−2 P $R2_{max}$=2 L+3 S−4 P=5 S $R2_{max/R1min}$=5 S/2 S=5/2

That is, the minimum length achievable using the two short segments 2 and one long segment 1 of one rod is equal to twice the length of the short segment 1. The maximum length achievable by combining two long segments and three short segments taken from two rods is five times the length of a short segment 1.

From the segments of two rods, each consisting of one long segment 1 and two short segments 2, a curtain rod can be formed having any length within a continuous range extending from $R1_{min}$ to $R2_{max}$.

It is to be appreciated that variations and modifications may be made to the invention without departing from the spirit and scope of the invention. For example, the cross sectional dimensions of the long segments 1 and short segments 2 may be interchanged whereby the long segments are nested or slidable within the short segments. Also, although the rods have been described as those used for hanging curtains, the invention will have utility with rods used in other applications, e.g., closet rods for hanging clothing, chinning rods for exercise, pipes used for plumbing, conduit for electrical lines, etc.

What is claimed is:

1. A telescoping rod comprising a first tubular member, a second tubular member shorter in length than said first tubular member, one of said first tubular member and said second tubular member being slidable within the other of said first tubular member and said second tubular member, said second tubular member extending from one end of said first tubular member, a third tubular member equal in length to said second tubular member, one of said first tubular member and said third tubular member being slidable within the other of said first tubular member and said third tubular member, said third tubular member extending from an end of said first tubular member opposite said one end, the length of said rod being continuously adjustable between a minimum length obtained when adjacent ends of said second tubular member and said third tubular member abut, and a maximum length obtained when said second tubular member and said third tubular member are separated, with an overlap between said first tubular member and said second tubular member having a length equal to the minimum length required to prevent sagging or separation of said first tubular member and said second tubular member and an overlap between said first tubular member and said third tubular member equal in length to the overlap between said first tubular member and said second tubular member, each of said second tubular member and said third tubular member having a length equal to the length of said first tubular member less twice the length of each overlap, wherein each overlap has a length of 6 percent of the length of said second member.

2. A telescoping rod comprising a first tubular member, a second tubular member shorter in length than said first tubular member, one of said first tubular member and said second tubular member being slidable within the other of said first tubular member and said second tubular member, said second tubular member extending from one end of said first tubular member, a third tubular member equal in length to said second tubular member, one of said first tubular member and said third tubular member being slidable within the other of said first tubular member and said third tubular member, said third tubular member extending from an end of said first tubular member opposite said one end, a fourth tubular member equal in length to said first tubular member, one of said fourth tubular member and said third tubular member being slidable within the other of said fourth tubular member and said third tubular member, said third tubular member extending from one end of said fourth tubular member, a fifth tubular member equal in length to said second tubular member, one of said fourth tubular member and said fifth tubular member being slidable within the other of said fourth tubular member and said fifth tubular member, said fifth tubular member extending from an end of said fourth tubular member opposite said one end, the length of said rod being continuously adjustable between a minimum length obtained when adjacent ends of said second tubular member and said third tubular member abut, and when adjacent ends of said third tubular member and said fifth tubular member abut, and a maximum length of said telescoping rod obtained when said second tubular member and said third tubular member are separated, and said third tubular member and said fifth tubular member are separated, with an overlap between said first tubular member and said second tubular member having a length equal to the minimum length required to prevent sagging or separation of said first tubular member and said second tubular member, an overlap between said first tubular member and said third tubular member equal in length to the overlap between said first tubular member and said second tubular member, an overlap between said fourth tubular member and said third tubular member equal in length to the overlap between said first tubular member and said second tubular member, and an overlap between said fourth tubular member and said fifth tubular member equal in length to the overlap between said first tubular member and said second tubular member, each of said second tubular member, said third tubular member and said fifth tubular member having a length equal to the length of said first tubular member less twice the length of each overlap, wherein each overlap has a length of 6 percent of the length of said second member.

3. Apparatus from which a telescoping rod may be assembled comprising, a first tubular member having a length of L, a second tubular member having a length of S, a third tubular member having a length of S, a fourth tubular member having a length of L, and a fifth tubular member having a length of S, the length of a first telescoping rod formed by slidably mounting said second tubular member and said third tubular on said first tubular member being continuously adjustable between a minimum length of 2 S obtained when adjacent ends of said second tubular member and said third tubular member abut, and a maximum length of 2 S+L−2 P being obtained when said second tubular member and said third tubular member are separated, with an overlap between said first tubular member and said second tubular member having a length equal P and an overlap between said first tubular member and said third tubular member equal to P, where S=L−2 P, and the length of a second telescoping rod formed by slidably mounting said second tubular member and said third tubular on said first tubular member and by slidably mounting said third tubular member and said fifth tubular on said fourth tubular member being continuously adjustable between a minimum length of 3 S obtained when adjacent ends of said second tubular member and said third tubular member abut and adjacent ends of said third tubular member and said fifth tubular member abut, and a maximum length of 3 S+2 L−4 P being obtained when said second tubular member and said third tubular member are separated, with an overlap between said first tubular member and said second tubular member having a length equal P and an overlap between said first tubular member and said third tubular member equal to P, and when said third tubular member and said fifth tubular member are separated, with an overlap between said third tubular member and said fourth tubular member having a length equal P and an overlap between said fourth tubular member and said fifth tubular member equal to P, where S=L−2 P, wherein the maximum length of said first telescoping rod is equal to 2 S+L−2 P and the minimum length of said second telescoping rod is equal to 3 S.

4. Apparatus from which a telescoping rod may be assembled comprising, a first tubular member having a length of L, a second tubular member having a length of S, a third tubular member having a length of S, a fourth tubular member having a length of L, and a fifth tubular member having a length of S, the length of a first telescoping rod formed by slidably mounting said second tubular member and said third tubular on said first tubular member being continuously adjustable between a minimum length of 2 S obtained when adjacent ends of said second tubular member and said third tubular member abut, and a maximum length of 2 S+L−2 P being obtained when said second tubular member and said third tubular member are separated, with an overlap between said first tubular member and said second tubular member having a length equal P and an overlap between said first tubular member and said third tubular member equal to P, where S=L−2 P, and the length of a second telescoping rod formed by slidably mounting said second tubular member and said third tubular on said first tubular member and by slidably mounting said third tubular member and said fifth tubular on said fourth tubular member being continuously adjustable between a minimum length of 3 S obtained when adjacent ends of said second tubular member and said third tubular member abut and adjacent ends of said third tubular member and said fifth tubular member abut, and a maximum length of 3 S+2 L−4 P being obtained when said second tubular member and said third tubular member are separated, with an overlap between said first tubular member and said second tubular member having a length equal P and an overlap between said first tubular member and said third tubular member equal to P, and when said third tubular member and said fifth tubular member are separated, with an overlap between said third tubular member and said fourth tubular member having a length equal P and an overlap between said fourth tubular member and said fifth tubular member equal to P, where S=L−2 P, wherein the maximum length of said second telescoping rod is equal to 3 S+2 L−4 P and the minimum length of said first telescoping rod is equal to 2 S.

* * * * *